US010246915B2

(12) United States Patent
Brunnmayr

(10) Patent No.: US 10,246,915 B2
(45) Date of Patent: Apr. 2, 2019

(54) SUPPORTING DEVICE FOR A FURNITURE FLAP

(71) Applicant: Julius Blum GmbH, Hoechst (AT)

(72) Inventor: Harald Brunnmayr, Hoerbranz (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 15/667,990

(22) Filed: Aug. 3, 2017

(65) Prior Publication Data

US 2017/0328103 A1 Nov. 16, 2017

Related U.S. Application Data

(63) Continuation of application No. PCT/AT2016/000009, filed on Feb. 11, 2016.

(30) Foreign Application Priority Data

Feb. 13, 2015 (AT) ..... A 72/2015

(51) Int. Cl.
*E05D 3/14* (2006.01)
*E05D 15/32* (2006.01)
*E06B 3/44* (2006.01)

(52) U.S. Cl.
CPC ..... *E05D 3/142* (2013.01); *E05D 3/14* (2013.01); *E05D 15/32* (2013.01); *E06B 3/443* (2013.01); *E05Y 2900/20* (2013.01); *E05Y 2900/212* (2013.01)

(58) Field of Classification Search
CPC ..... E05D 3/14; E05D 3/142; E05D 15/30; E05D 15/32; E05D 15/38; E05D 15/46; E06B 3/443
USPC ..... 16/277, 289, 290, 295–296
See application file for complete search history.

(56) References Cited

U.S. PATENT DOCUMENTS 4,760,623 A * 8/1988 Toyama ..... E05D 7/0407 16/238
5,500,983 A 3/1996 Lautenschläger
5,904,411 A 5/1999 Hayakawa
5,971,514 A 10/1999 Hayakawa
(Continued)

FOREIGN PATENT DOCUMENTS

CN 1133789 1/2004
CN 103109029 5/2013
(Continued)

OTHER PUBLICATIONS

International Search Report dated May 12, 2016 in International (PCT) Application No. PCT/AT2016/000009.
(Continued)

*Primary Examiner* — Roberta S Delisle
(74) *Attorney, Agent, or Firm* — Wenderoth, Lind & Ponack, L.L.P.

(57) ABSTRACT

A supporting device for a furniture flap can be connected to a furniture body and a furniture flap in an articulated manner. The supporting device has a first supporting arm and a second supporting arm, and the first and the second supporting arms overlap without a gap laterally with respect to the direction of motion of the supporting device in each position of the supporting device. The first supporting arm and the second supporting arm are profiled in the cross-section and are nested in each other.

19 Claims, 9 Drawing Sheets

(56) References Cited

U.S. PATENT DOCUMENTS

| | | | | |
|---|---|---|---|---|
| 6,374,459 | B1 * | 4/2002 | Zetti | E05D 3/16 16/286 |
| 7,406,749 | B2 * | 8/2008 | Herper | E05F 5/006 16/286 |
| 7,480,962 | B2 * | 1/2009 | Takamatsu | E05D 5/08 16/258 |
| 7,966,699 | B2 | 6/2011 | Dubach et al. | |
| 8,250,705 | B2 * | 8/2012 | Oshima | E05D 7/0407 16/236 |
| 8,296,906 | B2 * | 10/2012 | Wisniewski | E05D 3/14 16/250 |
| 8,321,996 | B2 * | 12/2012 | Hirtsiefer | E05D 3/14 16/286 |
| 8,904,600 | B2 | 12/2014 | Sugasawara et al. | |
| 2002/0189052 | A1 | 12/2002 | Melhuish | |
| 2008/0134464 | A1 | 6/2008 | Salice | |
| 2008/0209682 | A1 | 9/2008 | Dubach et al. | |
| 2008/0238276 | A1 * | 10/2008 | Migli | E05D 5/065 312/326 |
| 2011/0083299 | A1 * | 4/2011 | Krudener | E05D 7/0407 16/319 |
| 2011/0204072 | A1 * | 8/2011 | Sugasawara | E05D 15/34 220/810 |
| 2012/0117884 | A1 | 5/2012 | Oshima | |

FOREIGN PATENT DOCUMENTS

| | | |
|---|---|---|
| DE | 20 2010 015 091 | 3/2012 |
| EP | 0 623 725 | 11/1994 |
| EP | 2 093 361 | 8/2009 |
| EP | 2 400 093 | 12/2011 |
| JP | 2004-124455 | 4/2004 |
| JP | 2009-511781 | 3/2009 |
| SU | 1680917 | 9/1991 |
| WO | 2007/045631 | 4/2007 |

OTHER PUBLICATIONS

Search Report dated Nov. 26, 2015 in Austrian Application No. A 27/2015, with English translation.

English translation of Search Report issued with Chinese Office Action dated Aug. 28, 2018.

* cited by examiner

SUPPORTING DEVICE FOR A FURNITURE FLAP

BACKGROUND OF THE INVENTION

The present invention concerns a support device for a furniture flap, and an article of furniture having at least one such support device.

Support devices for furniture flaps are known in many different configurations in the state of the art. U.S. Pat. No. 8,904,600 B2 describes, for example, a hinge device for an article of furniture having a furniture door which has fixing means at the carcass side, two or three lever arms hingedly fixed thereto, and door-side fixing means which are also hingedly fixed to the lever arms. The aim of that hinge device is to guide an opening or closing movement of a furniture door, in which case the furniture door is not rotated about a perpendicular axis of rotation but rather is displaced parallel in a horizontal plane. That is achieved by a parallel kinematic arrangement comprising two or three levers of equal length, which at the body side and the door side are rotatably mounted at respectively equal spacings and in arrangements about perpendicular axes of rotation. A disadvantage with that state of the art is the complicated and expensive structure of the parallel kinematic arrangement and the formation of a shearing gap, caused by the arrangement of the lever arms, and the risk of injury linked thereto when the furniture door is operated by a user.

Further support devices are known for example from EP 2 093 361 A2 and US 2002/0189052 A1.

SUMMARY OF THE INVENTION

The object of the present invention is to provide a support device for a furniture flap, which is improved over the state of the art and which in particular is technically easy to produce and which is distinguished by a high level of operational reliability and safety.

That object is attained by a support device for a furniture flap having the features described below, and an article of furniture having at least one such support device.

By virtue of the fact that the support device has a first support arm and a second support arm, and the first and second support arms overlap gap-free in all positions of the support device laterally with respect to the direction of movement of the support device, it is possible to achieve a particularly stable structure for the support device. The configuration of two support arms means that it is possible for influences of torsional forces, flexural forces or generally forces which occur upon movement of the support device to be kept low. The avoidance of the formation of a shearing gap between the support arms, which gap occurs laterally with respect to the direction of movement of the support device, by virtue of a gap-free overlap between them, means that the risk of injury by for example a hand or a finger of a user being nipped upon actuation of the support device by the user can be minimized. In addition, the gap-free overlap of the support arms, laterally with respect to the direction of movement, makes it possible to provide a compact structure for the support device, which can also be distinguished by a high degree of aesthetics by virtue of the integral appearance that can be achieved thereby. In the case of a support device for an upwardly pivotable flap, the gap-free overlap of the first and second support arms is in a lateral direction, that is to say horizontally with respect to the perpendicular direction of movement of the support device in this case. The fact that the first and second support arms in any position of the support device overlap without a gap laterally with respect to the direction of movement of the support device signifies that the overlap is in any position of the support device from a position corresponding to a closed position of a furniture flap which can be fixed thereto, to a position corresponding to an open position of a furniture flap which can be fixed thereto.

By virtue of the fact that at a first end, which is preferably arranged upwardly in the mounted position, the first support arm can be connected to a furniture carcass pivotably about a first pivot axis and wherein at a first end, which is preferably arranged upwardly in the mounted position, the second support arm can be connected to a furniture carcass pivotably about a second pivot axis, preferably by way of a housing, it is possible for the support arms to be in the form of pivotal arms. That can allow a pivotal movement, that is to say, also simultaneous translation and rotation of a furniture flap which can be fitted to the support device. The connection by way of a housing permits a simple structure and easy fitment of the support device.

The fact that the first support arm at a second end, which is preferably arranged downwardly in the mounted position and the second support arm at a second end, which is preferably arranged downwardly in the mounted position, are connected together by a hinged connection permits coupling of the movement of the pivotal arms. Such a hinged connection which is connected to the pivotal arms can also permit fixing of a furniture flap to the support device.

The fact that the first support arm is connected rotatably about a first axis of rotation and the second support arm is connected rotatably about a second axis of rotation to the hinged connection can permit a technically simple and effective connection of the pivotal arms with the hinged connection. A rotatable mounting of the support arms at the hinged connection can also permit tilting of the hinged connection upon pivotal movement of the support arms.

The fact that the normal distance of the first pivot axis and the second pivot axis, as measured along a straight line connecting same, is less than the normal distance of the first axis of rotation and the second axis of rotation, as measured along a straight line connecting same, can provide particularly advantageous coupling of the movement of the support arms. Such an arrangement of the axes of rotation in relation to the pivot axes allows a particularly large range of pivotal movement of the support device without in that case the support arms impeding each other in the pivotal movement. Adaptation of the relationship of the normal distance of the pivot axes and the normal distance of the axes of rotation makes it easily possible to set the desired degree of tilting of the hinged connection upon pivotal movement of the support device, and thus the desired tilting of a furniture flap which can be fixed thereto.

The fact that the first support arm and the second support arm touch laterally with respect to the direction of movement of the support device or their spacing relative to each other laterally with respect to the direction of movement of the support device is less than or equal to 5 mm, preferably less than or equal to 1 mm, can permit a compact structure for the support device, which is also distinguished by a high level of operational reliability and safety for a user. By virtue of lateral contact of the support arms, which therefore is sideways in the case of an upwardly pivotal flap, or the formation of a small gap in the range of a few millimeters, the operational safety of the support device for a user can be increased in addition to the above-mentioned features and pinching can be particularly effectively prevented. In addition, such a structure can permit the provision of a support device which requires a particularly small amount of space.

By virtue of the fact that the first support arm and the second support arm are profiled in cross-section and nested in each other, it is possible for a support device with a high level of stability to be particularly easily produced by a manufacturing procedure. An internested arrangement of the first and second support arms makes it particularly easily possible to implement a compact and substantially gap-free configuration for the support device. In addition, the demands in terms of operational safety and aesthetics can also be easily met by an internested arrangement of the support arms.

The fact that the shape of the cross-section of the first support arm substantially corresponds to a U-shaped profile means that a configuration of the first support arm, that is stable while involving a small amount of space, can be particularly easily and inexpensively produced in a manufacturing procedure.

By virtue of the fact that the shape of the cross-section of the second support arm substantially corresponds to a U-shaped profile or a rectangle means that it is possible to produce a stable design of the second support arm in an inexpensive and technically simple fashion.

The fact that in any position of the support device, the second support arm is arranged at least partially within the cavity formed by the profile of the first support arm makes it possible to achieve a particularly compact and stable structure for the support device. The at least partial arrangement of the second support arm within the cavity formed by the profile of the first support arm permits particularly simple attainment of an internested arrangement of the support arms and thus permits a gap-free configuration, laterally with respect to the direction of movement of the support device, in any position thereof.

The fact that the support device has an electrical or spring-loaded mechanical drive can permit the support device to be of a particularly simple design.

An article of furniture including a furniture carcass, a furniture flap, and at least one support device for the furniture flap can also be provided. Such an article of furniture is distinguished by a particularly compact configuration of the support device together with the furniture flap. By using a support device according to the invention, additional pivotal arms formed separately from the support device for assisting with the opening or closing movement of the furniture flap can be eliminated. The nesting of the support arms, that is gap-free in any position, laterally, that is to say in the case of upwardly pivotable flaps for example in the lateral direction relative to the upward pivotal movement of the support device, provides a design of a support device, which acts in a one-piece structure and which is compact and which is operationally safe for a user, together with the furniture flap. In addition, such an article of furniture is distinguished by the above-mentioned fact that it is possible to dispense with additional control elements which project out of the furniture carcass, by virtue of the capability of good lateral engagement with the furniture flap in the open condition into the internal space provided in the carcass of the article of furniture.

By virtue of the fact that, in a closed condition of the furniture flap, the support device is disposed substantially completely in the interior of the internal space in the article of furniture, afforded by the carcass thereof, no additional operations or modifications have to be made to dispose the support device in the interior of the article of furniture at the furniture flap. This also makes it possible for the furniture flap to bear substantially against the furniture carcass in the closed position of the furniture flap.

The fact that the angular position of a furniture flap mounted by way of the hinged connection to the support device is altered relative to the furniture carcass upon pivotal movement of the support device can make it easier to gain access into the internal space of the furniture carcass, when the furniture flap is opened. The change in the angular position of the furniture flap relative to the furniture carcass upon pivotal movement of the support device can also permit an intuitive opening and closing movement for the furniture flap by a user.

The fact that the first pivot axis and the second pivot axis, as well as the first axis of rotation and the second axis of rotation, extend horizontally in the mounted condition of the support device means that it is also possible with the support device to implement an upwardly pivotable flap, that is to say a furniture flap which is pivoted upwardly for opening or closing the same.

The fact that the open side of the U-shaped profile of the first support arm in the mounted condition of the support device is towards the furniture flap makes it possible to achieve a particularly high level of operational safety, a uniform appearance with attractive aesthetics and a compact design for the support device with furniture flap.

BRIEF DESCRIPTION OF THE DRAWINGS

Further details and advantages of the present invention will be described more fully hereinafter by means of the specific description with reference to the embodiments illustrated in the drawings, in which.

DETAILED DESCRIPTION OF THE INVENTION

Figure 1A:
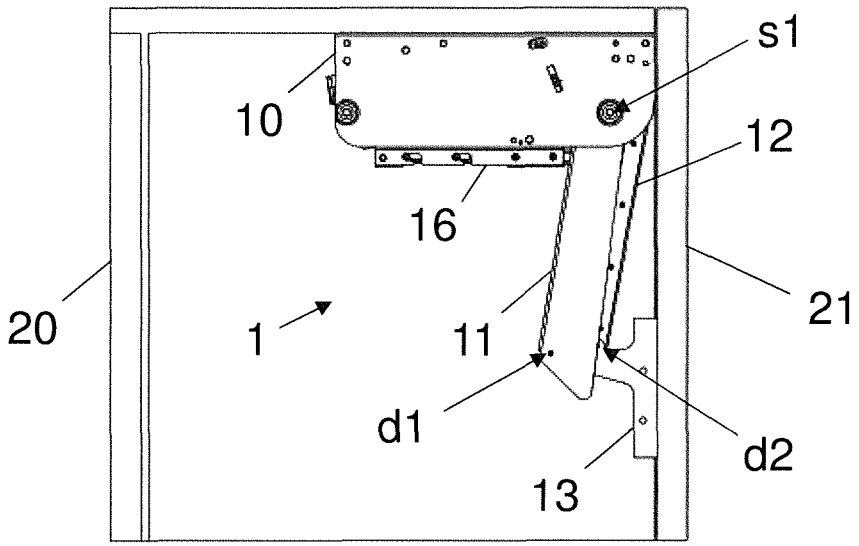
FIG. 1*a* through 1*d* are side views of a support device in various positions.

FIG. 1*a* shows a support device 1 in a position corresponding to a closed position of a furniture flap 21. In this arrangement, the support device 1 has a housing 10 which can be mounted to a furniture carcass 20 and having a first support arm 11 mounted pivotably about a first pivot axis s1, and a second support arm 12 mounted pivotably about a second pivot axis s2 (not visible here). In this case, the first support arm 11 is further connected to a hinged connection 13 which is mounted rotatably about a first axis of rotation d1 and which is also connected to the second support arm 12 rotatably about a second axis of rotation d2. The movement of the first and second support arms 11, 12 is thus coupled by the hinged connection 13. In this position of the support device 1 (corresponding to the closed position), the second support arm 12 is arranged partially in the cavity afforded by the profile of the first support arm 11 substantially over the entire length of the second support arm 12 that projects from the housing 10, with respect to its heightwise extent. Thus, in the direction of viewing FIG. 1*a* (that is to say laterally or sideways with respect to the pivotal movement), possible in the counter-clockwise direction of movement of the first and second support arms 11, 12, there is a gap-free overlap between the two support arms 11, 12. The support device 1 further has a damping unit 16 which is fixed to the housing 10 and which, in this position of the support device 1 that corresponds to a closed position, in a maximum retracted state which occurs after a damping action has taken place, bears against the first support arm 11.

Figure 1B:
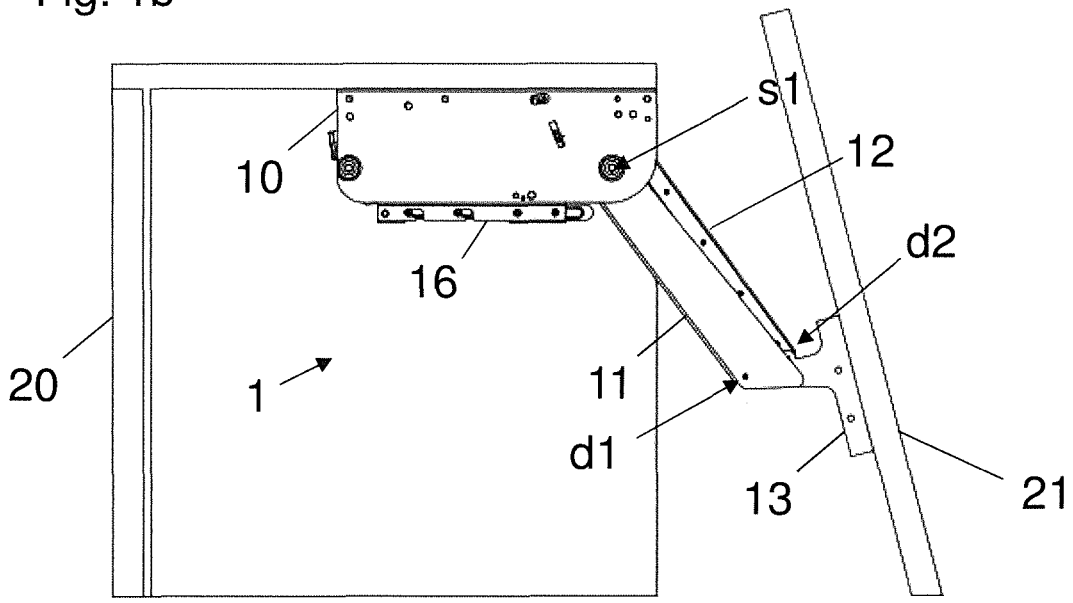

FIG. 1*b* shows an intermediate position of the support device which corresponds to a position that occurs shortly after opening or shortly before closing of a furniture flap 21 which can be fixed to the support device 1. In comparison with the position shown in FIG. 1*a*, the first support arm 11 and the second support arm 12 are pivoted in the counter-clockwise direction (relative to this side view) about the first and second pivot axes s1, s2, respectively. The first support arm 11 now also no longer bears against the damping unit 16 which, as a result, is in a completely extended condition. By virtue of the inequality of the normal distance between the first and second pivot axes s1, s2 and the normal distance between the first and second axes of rotation d1, d2 (see FIG. 3), the pivotal movement of the first and second support arms 11, 12 gives rise to simultaneous translation and rotation of the hinged connection 13, and thus also translation and rotation of a furniture flap 21 which can be fixed thereto. Maintenance of the internested arrangement of the first support arm 11 and the second support arm 12 also results in this position in an overlap between the support arms 11, 12, which overlap is gap-free laterally or sideways with respect to the direction of movement.

Figure 1C:
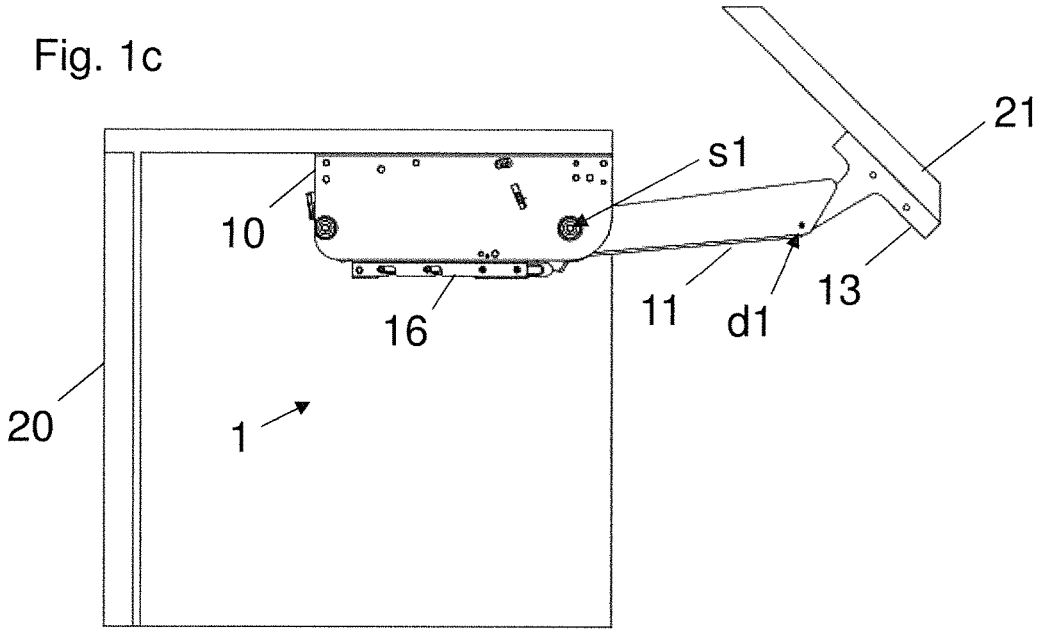

FIG. 1*c* shows the support device 1 in a position corresponding to an almost completely opened position of a furniture flap 21. In this position, the second support arm 12 is arranged substantially completely in the interior of the cavity afforded by the profile of the first support arm 11 and is thus not visible in this view. It can be clearly seen in contrast that the hinged connection 13 is tilted in relation to its starting position as shown in FIG. 1*a*, this being to a lesser degree than would occur for example in the case of the hinged connection 13 being non-rotatably connected to the first support arm 11. Rather, the coupling of the movement of the first and second support arms 11, 12 by the hinged connection 13, the arrangement of the first and second pivot axes s1, s2, the fixed arm length of the support arms 11, 12, and the arrangement of the first and second pivot axes s1, s2 results in a pivotal movement of the hinged connection 13 relative to the first support arm 11, which pivotal movement is oriented in opposite relationship to the direction of movement of the support arms 11, 12 of the support device 1.

Figure 1D:
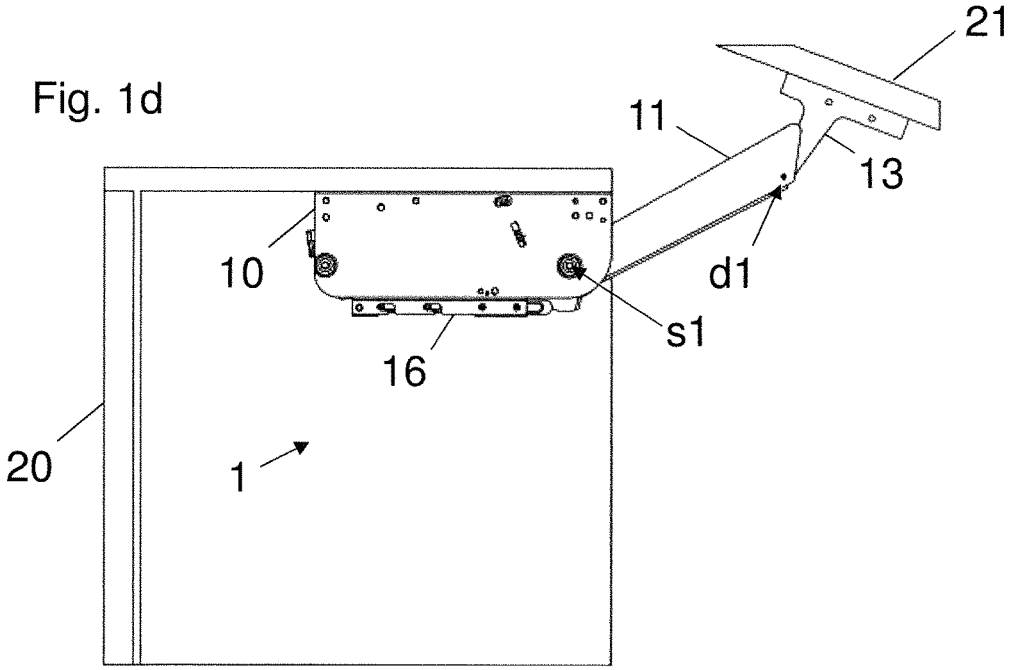

FIG. 1*d* shows the support device 1 in a position corresponding to a completely opened furniture flap 21. In this position, the support arms 11, 12 involve a maximum degree of internesting, wherein the second support arm 12 is arranged substantially completely within the cavity provided by the profile of the first support arm 11. Likewise, the hinged connection 13 is pivoted at its maximum with respect to the first support arm 11, whereby, for a furniture flap 21 which can be mounted thereto, it can be provided that the lower edge thereof is still in a region that a user can readily reach. In addition, the overlap of the two support arms 11, 12 that is gap-free in the lateral direction affords a user a particularly safe support device for a furniture flap as in that way it offers no possibility of inserting the hand or the fingers into a gap and becoming pinched upon pivotal movement of the support device.

Figure 2A:
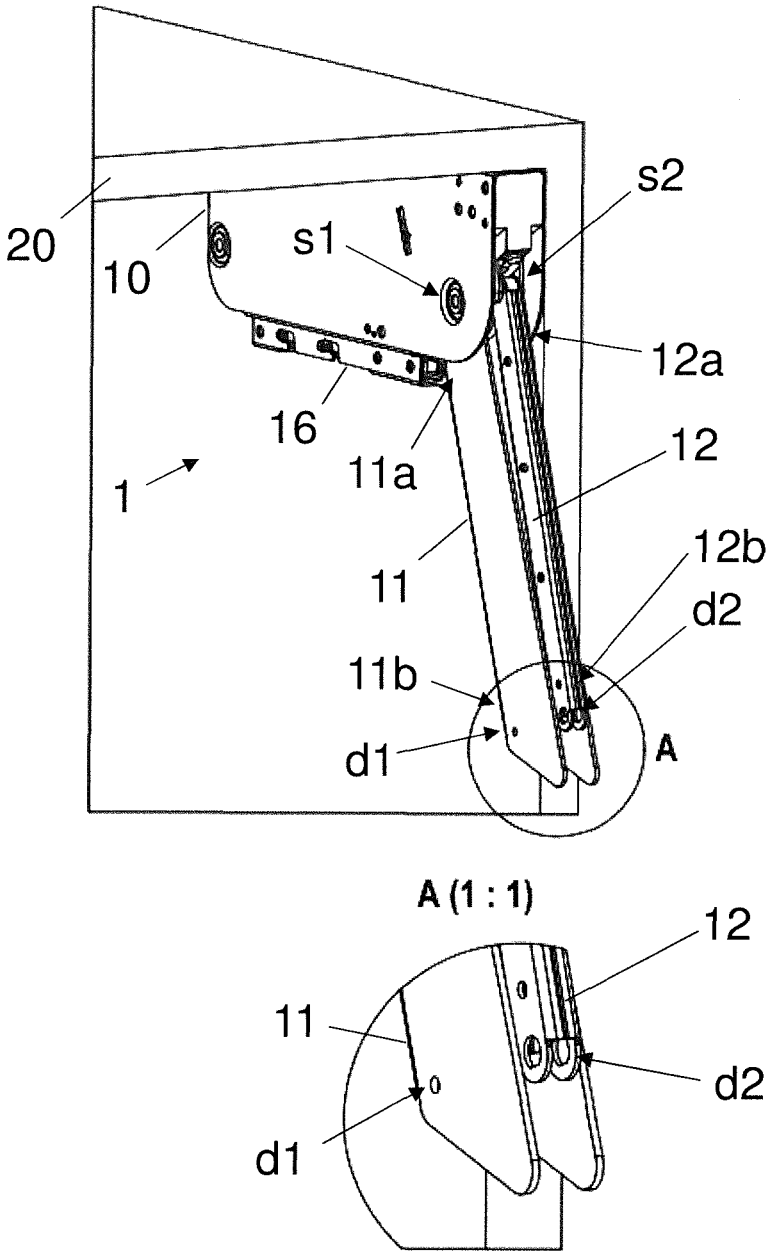
FIGS. 2*a* through 2*c* are perspective views of a support device in various positions.

FIG. 2*a* shows a perspective view of a support device 1, wherein the hinged connection 13 is not shown for improved visibility of the end portions of the first and second support arms 11, 12. It is again firstly possible to see the housing 10 and the damping unit 16 which is fixed thereto and which acts on the first support arm 11. The first support arm 11 is mounted to the housing 10 pivotably about a first pivot axis s1, at a first end 11*a* which as shown is upward in the mounted position. Similarly thereto, at a first end 12*a* which as shown is arranged upwardly in the mounted position, the second support arm 12 is mounted to the housing 10 pivotably about a pivot axis s2. At a second end 11*b* of the first support arm 11, that as shown is downward in the mounted position, there is a first axis of rotation d1 for rotatable mounting of the hinged connection 13. Once again, similarly thereto at a second end 12*b* of the second support arm 12 which as shown is arranged downwardly in the mounted position, there is a second axis of rotation d2 for rotatable mounting of the hinged connection 13. The arrangement of the first axis of rotation d1 and the second axis of rotation d2 is also shown again in an enlarged portion A. The orientation of the first and second pivot axes s1, s2 and the orientation of the first and second axes of rotation d1, d2 are horizontal in this embodiment, and the direction of pivotal movement of the support arms 11, 12 can thus take place in a perpendicular plane.

Figure 2B:
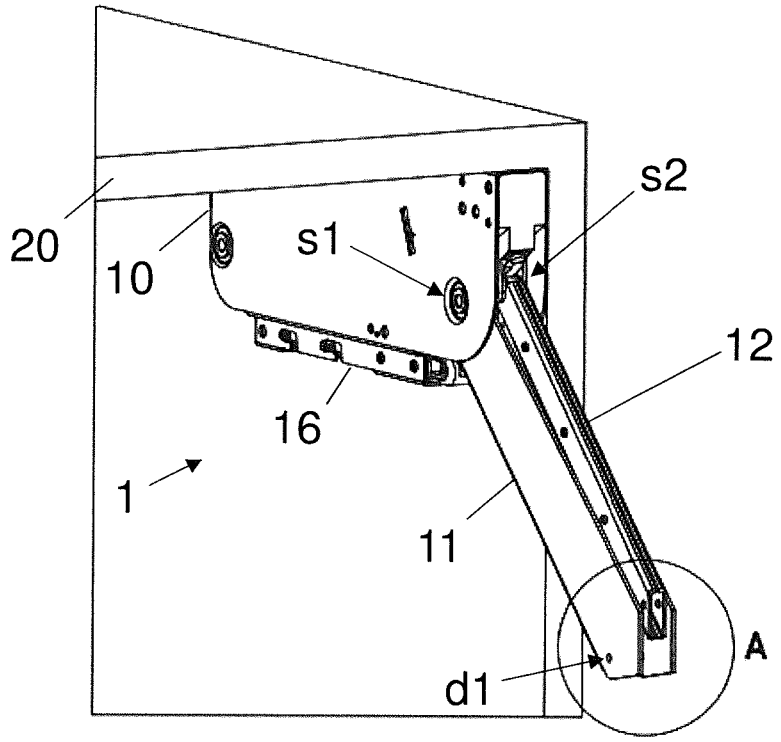
Figure 2B:
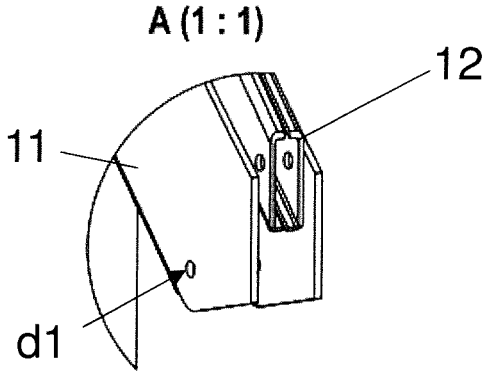

FIG. 2*b* shows a perspective view of a support device 1, the position of which corresponds to a position of a partially opened furniture flap. With the support device 1 in this position, the damping unit 16 precisely no longer bears or does not yet bear against the first support arm 11. As can be seen from the detail view A, the second support arm 12 substantially involves a cross-sectional shape of a rectangle. The second support arm 12 is also arranged in the interior of the U-shaped profile of the first support arm 11, partially along the heightwise extent of the second support arm, which is perpendicular in this view.

Figure 2C:
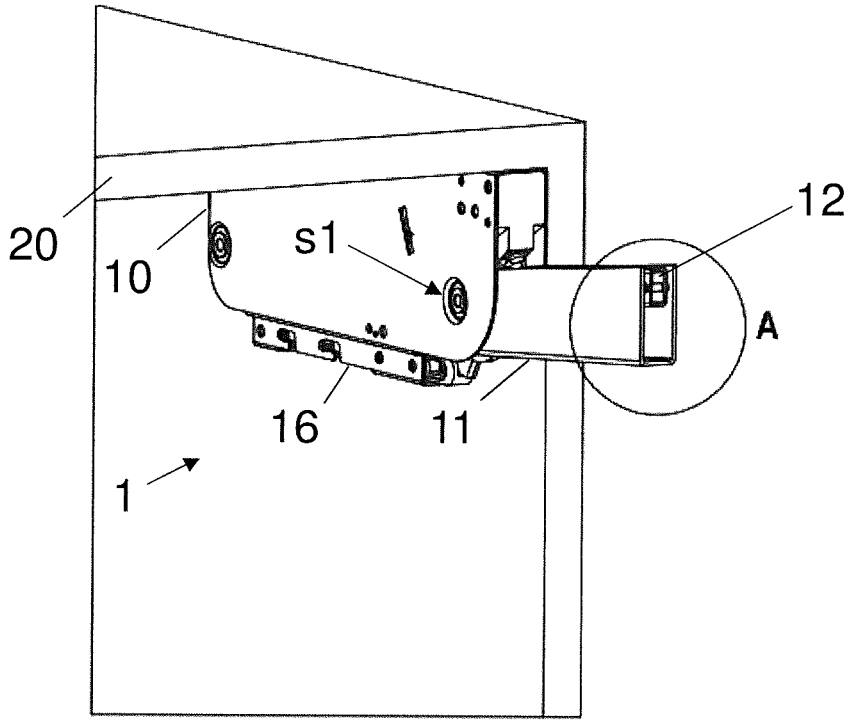
Figure 2C:
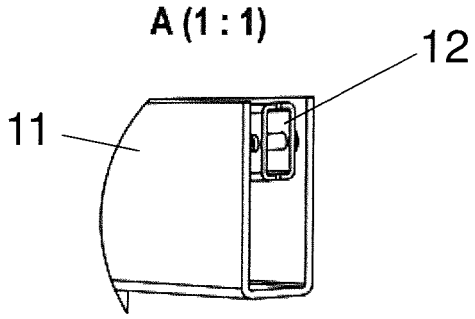

FIG. 2*c* shows a perspective view of a support device 1 in a position corresponding to an almost completely opened furniture flap 21. In this case, the first and second support arms 11, 12 are only partially shown for better visibility of the profile shapes. As can be seen from the detail view A, the first support arm 11 has a cross-sectional shape substantially corresponding to a U-shaped profile. In the position of the support device 1 shown in FIG. 2*c* and corresponding to an almost completely opened position of a furniture flap 21, the second support arm 12 along its heightwise extent which is perpendicular in this view, is arranged substantially completely between the perpendicular flanks (legs) of the U-shaped profile forming the first support arm 11. The open side of the U-shaped profile of the first support arm 11 is towards a furniture flap 21 which can be mounted to the support device 1 (that is to say, the open side of first support arm 11 is substantially facing away from the internal space 22 of a furniture carcass 20 (see FIG. 5*b*)). In this configuration, the shape of the cross-section of the second support arm 12 substantially corresponds to a rectangle, in which case that cross-sectional shape is afforded by two mutually facing U-shaped profiles riveted in butting relationship.

Figure 3:
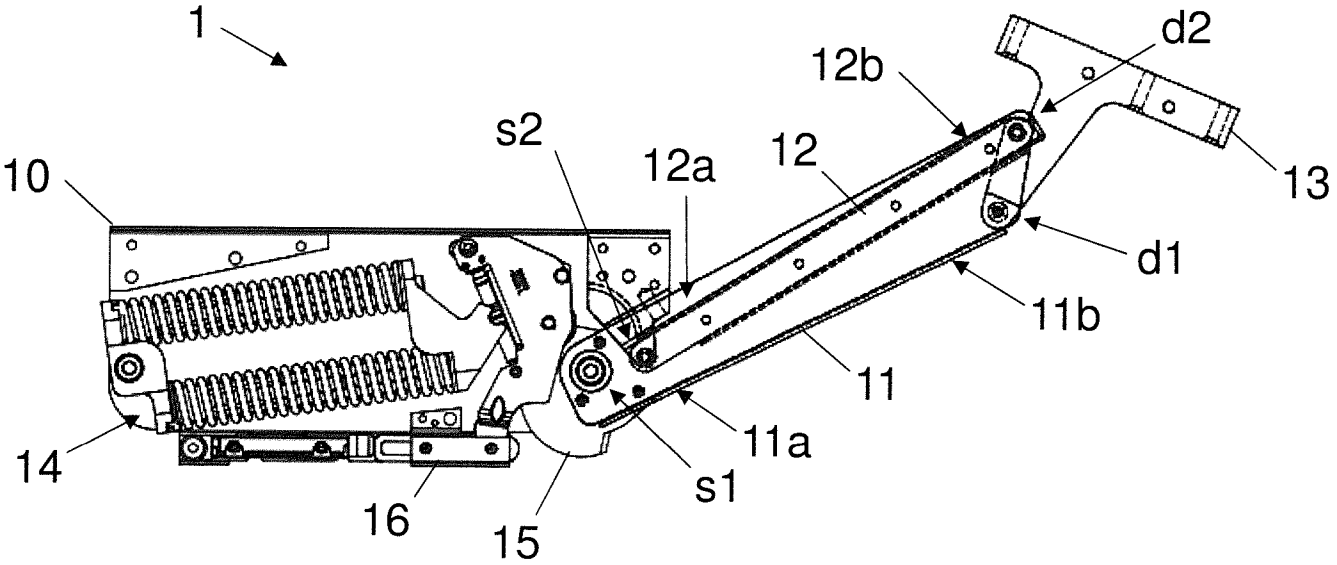
FIG. 3 is a side view in section of a support device.

FIG. 3 shows a side view in section of a support device 1. In this case, the support device 1 is in a position corresponding to an open position of a furniture flap 21 (not shown). FIG. 3 shows the housing 10 of the support device 1 with a spring-loaded mechanical drive 14 which is arranged therein and which acts on the first support arm 11 by a control cam 15. Also provided on the housing 10 is a damping unit 16 for damping the closing movement of a furniture flap 21. The first support arm 11 is connected at a first end 11*a* to the housing 10 pivotably about a first pivot axis s1. At the second end 11*b*, the first support arm 11 is connected to a hinged connection 13 rotatably about a first axis of rotation d1. At the first end 12*a*, the second support arm 12 is connected to the housing 10 pivotably about a second pivot axis s2. At the second end 12*b*, the second support arm 12 is connected to the hinged connection 13 rotatably about a second axis of rotation d2. The hinged connection 13 which is connected in that way provides for coupling of the movement of the first and second support arms 11, 12 upon actuation of the support device 1. As can be seen in the position of the support device 1 shown in FIG. 3, the second support arm 12 is arranged in a substantially completely overlapping relationship with the first support arm 11 in the position of the support device 1 corresponding to an open position of a furniture flap 12. Thus, there is also no formation of a gap between the two support arms 11, 12 into which a user could laterally put their hand or the fingers and suffer damage thereto upon actuation of the support device 1. By virtue of the selection of the ratio of the normal distance between the first and second pivot axes s1, s2, as measured along a straight line connecting these pivot axes, and the normal distance between the first and second axes of rotation d1, d2, as measured along a straight line connecting these pivot axes, wherein that ratio in this embodiment is less than 1, the desired tilting movement of the angular position of the mounted furniture flap 21 relative to a furniture carcass 20 upon pivotal movement of a mounted support device 1 can be adapted to the height of a furniture carcass 20 or the height of a furniture flap 21.

FIGS. 4*a* through 4*d* diagrammatically show various configurations of cross-sectional shapes of the first and second support arms 11, 12 of the support device 1. The position of the support device 1 can in this case correspond to an intermediate position between the opened and the closed end positions of the range of pivotal movement of the support device 1. In this case, the first support arm 11 has a cross-sectional shape substantially corresponding to a U-shaped profile.

Figure 4A:
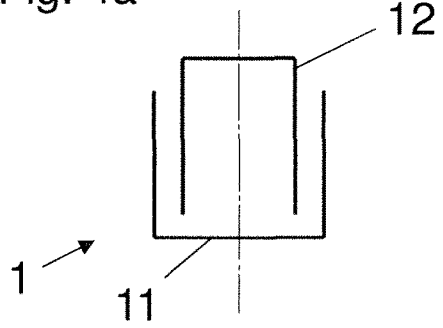
FIGS. 4*a* through 4*d* are diagrammatic views of various cross-sectional shapes of the support arms of a support device.

FIG. 4*a* shows a variant in which the second support arm 12 has a cross-sectional shape substantially corresponding to a U-shaped profile. In this case, the second support arm 12, over its heightwise extent, is arranged partially in the interior of the cavity afforded by the U-shaped profile of the first support arm 11, the open sides of the profiles of the first and second support arms 11, 12 respectively facing towards each other. In other words, the open side of the U-shaped profile of the second support arm 12 faces downward, while the open side of the U-shaped profile of the first support art 11 faces upward.

Figure 4C:
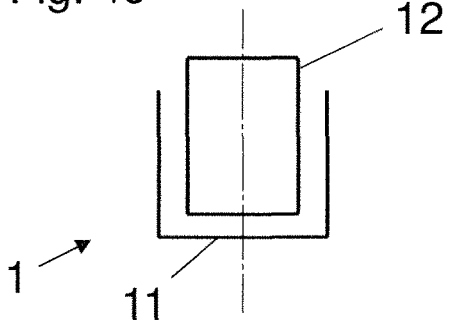
Figure 4B:
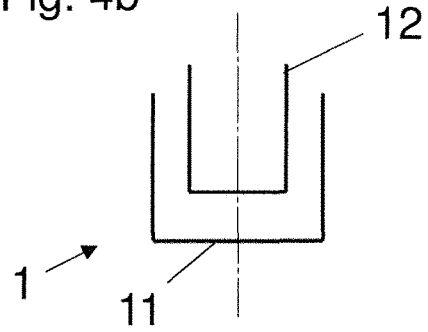

FIG. 4*b* shows a variant of the support device 1 in which the second support arm 12 has a cross-sectional shape substantially corresponding to a U-shaped profile. The second support arm 12 is again partially overlapping with the first support arm 11, along the heightwise extent of the second arm. In this embodiment, the first and second support arms 11, 12 are so nested that the profiles are respectively oriented in the same way. In other words, the open side of the U-shaped profile of the second support arm 12 faces upward, while the open side of the U-shaped profile of the first support art 11 also faces upward.

FIG. 4*c* shows a variant having a second support arm 12 which has a substantially rectangular cross-sectional profile.

Figure 4D:
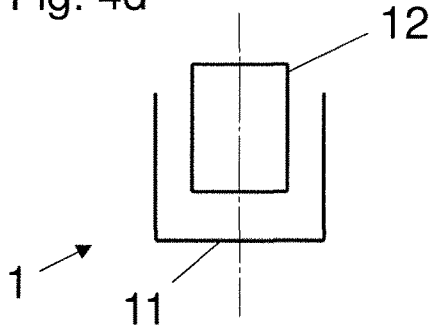

The cross-sectional shape of the second support arm 12 shown in FIG. 4*d* substantially corresponds to the cross-sectional shape of the second support arm 12 shown in FIG. 4*c*, but in FIG. 4*d* the cross-sectional area of the second support arm 12 is smaller than the cross-sectional area of the second support art 12 of the embodiment shown in FIG. 4*c*.

Figure 5A:
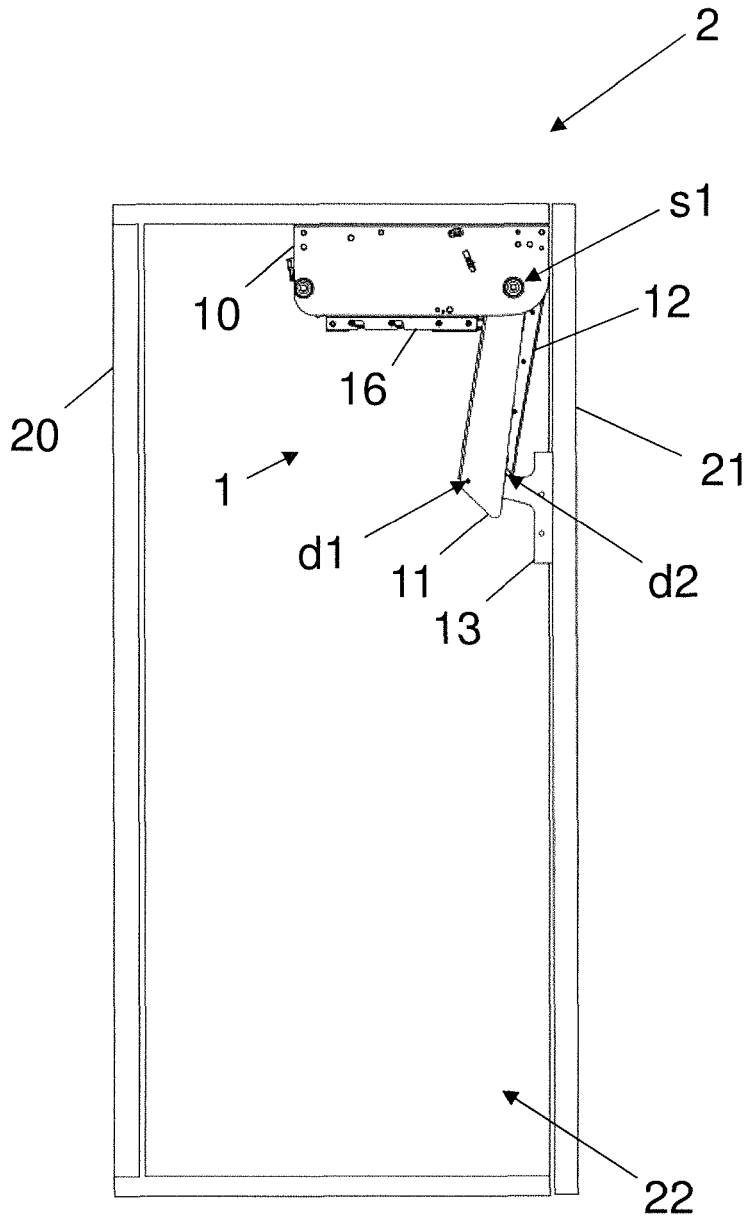
FIGS. 5*a* and 5*b* are side views of an article of furniture with a support device.

FIG. 5*a* shows a structure of an article of furniture 2 having a support device 1. The furniture flap 21 mounted to the hinged connection 13 of the support device 1 is in a completely closed position in the configuration shown in FIG. 5*a*.

In this case, the support device 1 is advantageously arranged in an upper region of the furniture carcass 20, for example at a side wall or a top panel, and is mounted by the housing 10. As shown in FIG. 5*a*, the support device 1 is disposed substantially completely in the interior of the internal space 22 of the article of furniture 2, defined by the furniture carcass 20. By the mechanical drive 14 (which is not visible from the exterior), the furniture flap 21 can in this case be held in the closed position with a force which can be easily overcome by a user.

Figure 5B:
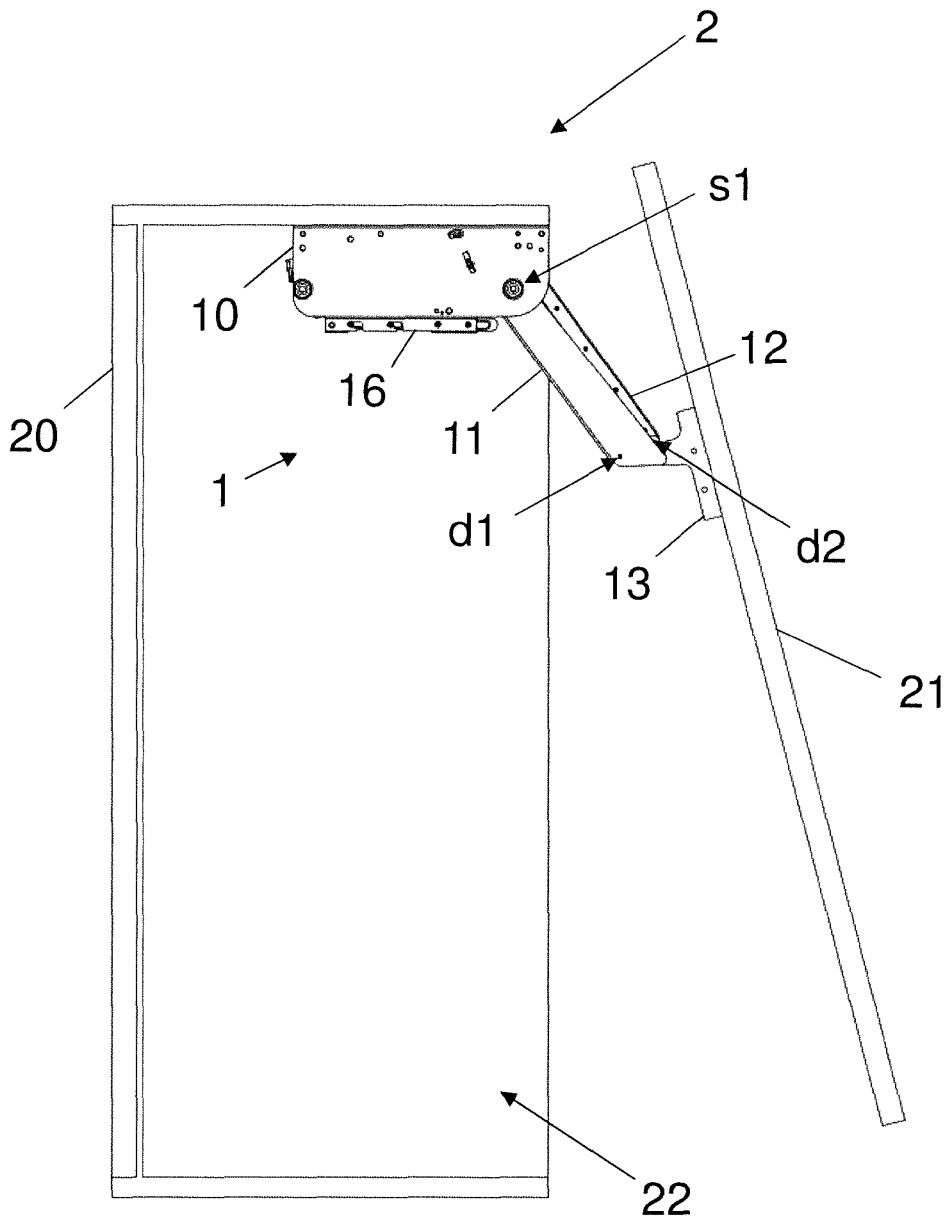

FIG. 5*b* shows a configuration of an article of furniture 2 having a support device 1 with a partially upwardly pivoted furniture flap 21. In this intermediate position of the support device 1, the first support arm 11 and the second support arm 12 are disposed in overlapping relationship which is gap-free laterally with respect to the direction of movement of the support arms 11, 12, this being achieved by the second support arm 12 in this and in any other position of the support device 1 being partially arranged within the cavity afforded by the profile of the first support arm 11. It can already be seen in this position of the partially opened furniture flap 21 that the possibility of a user laterally reaching into the internal space 22 defined by the furniture carcass 20 of the article of furniture 2 is not impeded by additional control elements projecting out of the furniture carcass 20. In addition, the mechanical drive 14 which is not visible from the exterior can assist with or also actively drive the opening or closing movement of the furniture flap 21. In addition, the furniture flap 21 can be held in an open position by the mechanical drive 14, with a force which a user can easily overcome. An article of furniture 2 having such a support device 1 for a furniture flap 21 is distinguished by convenient, intuitive and safe operability, while taking up a small amount of space and being easy to fit in place.

The invention claimed is:

1. A support device for a furniture flap, wherein the support device is to be hingedly connected to a furniture carcass and a furniture flap, said support device comprising:

a first support arm for supporting the furniture flap; and a second support arm for supporting the furniture flap, the first support arm and the second support arm being configured to overlap gap-free in all positions of the support device laterally with respect to the direction of movement of the support device, wherein the first support arm and the second support arm have a cross-sectional profile and are arranged inter-nested;

wherein each of the first support arm and the second support arm has a first end pivotally connected to a housing to be mounted to a furniture carcass, and each of the first support arm and the second support arm has a second end pivotally connected to a hinge connection to be mounted to a furniture flap.

2. The support device as set forth in claim 1, wherein the first support arm has a first end to be connected to the furniture carcass pivotably about a first pivot axis, and the second support arm has a first end to be connected to the furniture carcass pivotably about a second pivot axis.

3. The support device as set forth in claim 2, wherein the normal distance of the first pivot axis and the second pivot axis, as measured along a straight line connecting the first pivot axis and the second pivot axis, is less than a normal distance of the first axis of rotation and the second axis of rotation, as measured along a straight line connecting the first axis of rotation and the second axis of rotation.

4. The support device as set forth in claim 2, wherein both the first end of the first support arm and the first end of the second support arm are located upwardly in the closed position of the support device by a housing.

5. The support device as set forth in claim 1, wherein the first support arm has a second end, and the second support arm has a second end, the second end of the first support arm and the second end of the second support arm being connected together by a hinged connection.

6. The support device as set forth in claim 5, wherein the first support arm is connected rotatably about a first axis of rotation, and the second support arm is connected rotatably about a second axis of rotation to the hinged connection.

7. The support device as set forth in claim 5, wherein both the second end of the first support arm and the second end of the second support arm are located downwardly in the closed position of the support device.

8. The support device as set forth in claim 1, wherein the first support arm and the second support arm have lateral sides that touch each other.

9. The support device as set forth in claim 8, wherein the first support arm has a U-shaped profile in cross-section.

10. The support device as set forth in claim 8, wherein the second support arm has a U-shaped profile or a rectangular profile in cross-section.

11. The support device as set forth in claim 8, wherein the second support arm is arranged at least partially within a cavity formed by the profile of the first support arm in all positions of the support device.

12. The support device as set forth in claim 1, wherein the support device has an electrical drive or a spring-loaded mechanical drive.

13. An article of furniture comprising:

a furniture carcass, a furniture flap, and the support device as set forth in claim 1, the support device being mounted to the furniture carcass and to the furniture flap.

14. The article of furniture as set forth in claim 13, wherein, in a closed condition of the furniture flap, the support device is arranged substantially in an interior of the furniture carcass of the article of furniture.

15. The article of furniture as set forth in claim 13, wherein an angular position of the furniture flap mounted by a hinged connection at the support device changes relative to the furniture carcass upon pivotal movement of the support device.

16. The article of furniture as set forth in claim 13, wherein the first pivot axis, the second pivot axis, the first axis of rotation, and the second axis of rotation extend horizontally.

17. The article of furniture as set forth in claim 13, wherein an open side of the U-shaped profile of the first support arm faces the furniture flap in a closed position of the support device.

18. The support device as set forth in claim 1, wherein the first support arm and the second support arm have lateral sides spaced apart from each other laterally with respect to the direction of movement of the support device by a distance less than or equal to 5 mm.

19. The support device as set forth in claim 18, wherein the lateral sides are spaced apart from each other by a distance than or equal to 1 mm.

* * * * *